United States Patent [19]

Simonis

[11] Patent Number: 5,063,841

[45] Date of Patent: Nov. 12, 1991

[54] RECIPROCATING PISTON PRESS

[75] Inventor: Jürgen Simonis, Wolfenbüttel, Fed. Rep. of Germany

[73] Assignee: Gebrüder Welger GmbH & Co. Kommanditgesellschaft

[21] Appl. No.: 538,203

[22] Filed: Jun. 14, 1990

[30] Foreign Application Priority Data

Jun. 14, 1989 [DE] Fed. Rep. of Germany ..... 3919434

[51] Int. Cl.[5] ..... B30B 7/04; B30B 1/00; B30B 9/30

[52] U.S. Cl. ..... 100/142; 100/189

[58] Field of Search ..... 100/137-142, 100/179, 188 R, 189, 215; 56/341-344

[56] References Cited

U.S. PATENT DOCUMENTS

| | | | |
|---|---|---|---|
| 4,569,282 | 2/1986 | Galant | 100/189 |
| 4,819,418 | 4/1989 | Ratzlaff et al. | 100/189 X |
| 4,825,760 | 5/1989 | Weddeling | 100/189 X |

FOREIGN PATENT DOCUMENTS

| | | | |
|---|---|---|---|
| 130333 | 11/1932 | Austria | 100/189 |
| 627859 | 9/1961 | Canada . | |
| 54914 | 6/1938 | Denmark | 100/189 |
| 606825 | 12/1934 | Fed. Rep. of Germany | 100/188 R |
| 619318 | 9/1935 | Fed. Rep. of Germany | 100/189 |
| 904484 | 2/1954 | Fed. Rep. of Germany | 100/189 |

*Primary Examiner*—Harvey C. Hornsby
*Assistant Examiner*—Stephen F. Gerrity
*Attorney, Agent, or Firm*—Toren, McGeady & Associates

[57] ABSTRACT

In a reciprocating piston press where a compressing piston operates in a nonuniform manner, the piston cooperates with conveyor prongs which move material into the path of the piston. The conveyor prongs are guided by a crank and rocker linkage mechanism by way of elliptical gear wheels for movement around a kidney-shaped orbit. The prongs perform a more rapid motion in the region of a fill opening for charging material into a compaction channel containing the compressing piston. The reciprocating piston press is, in particular, employed for compacting cardboard waste in combination with a feeder space which opens into the compaction channel for charging cardboard waste into the channel. The feeder space and piston press are located in a stationary housing.

9 Claims, 1 Drawing Sheet

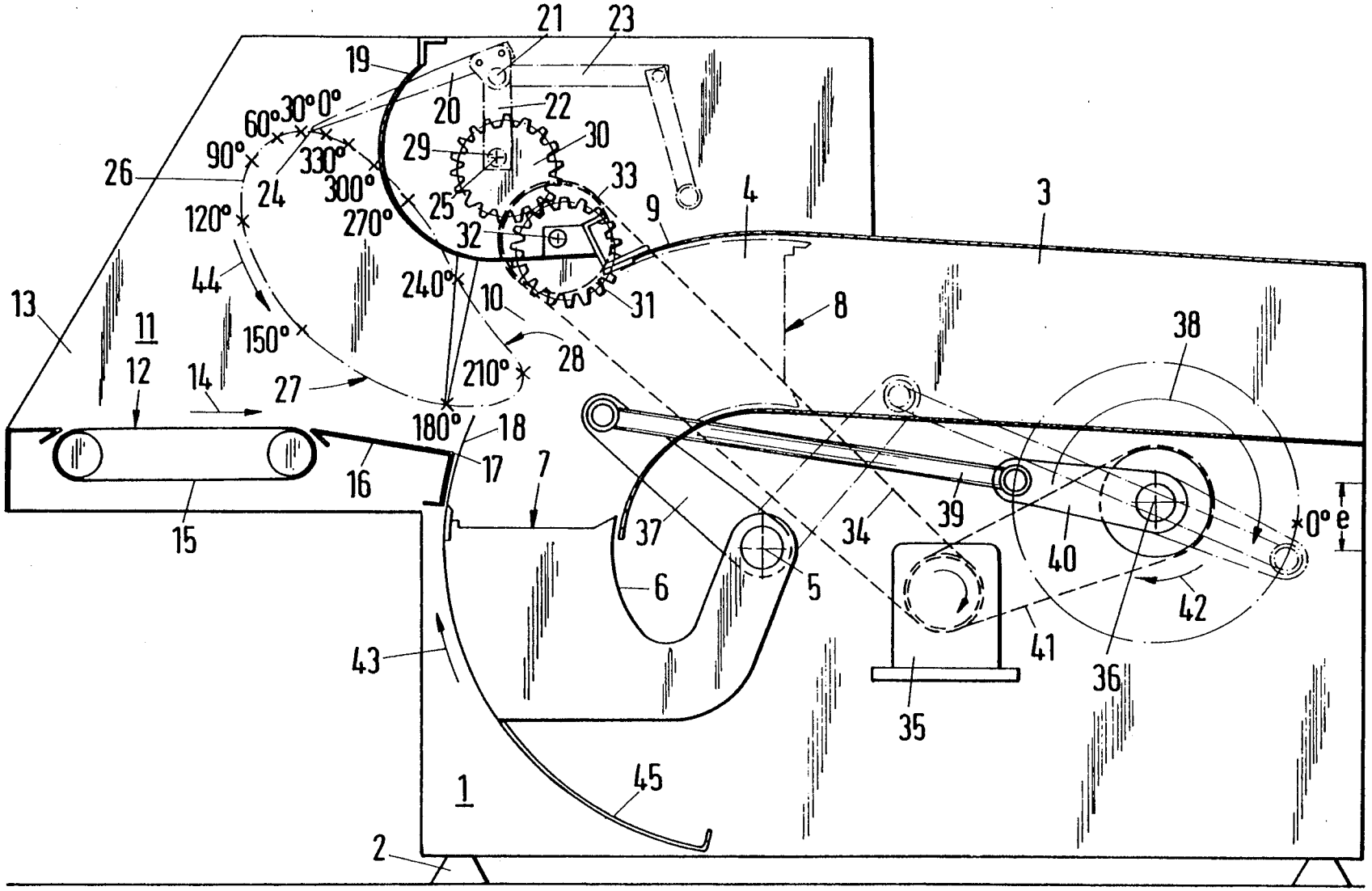
0°
e
38
42
36
3
40
41
39
35
34
8
5
4
9
37
6
45
23
33
31
30
28
21
22
7
10
210°
18
17
1
20
32
25
29
240°
180°
19
270°
300°
330°
0°
30°
60°
24
27
150°
90°
120°
44
14
16
43
2
15
11
12
26
13

RECIPROCATING PISTON PRESS

BACKGROUND OF THE INVENTION

The present invention is directed to a reciprocating piston press with a compaction channel having an arc-shaped section containing a compression piston arranged to reciprocate around a pivot point so that it moves back and forth in the channel. A supply arrangement conveys the material to be compacted into the channel through a fill opening and the supply arrangement operates in time-wise relationship with the compressing piston.

A known reciprocating piston press of the above type is disclosed in Canadian patent 627 859 and is designed as a mobile unit serving to gather fibrous crops, such as hay or straw lying on the ground in swaths by means of a pickup device and to compress the crops into bales and to tie the bales. Two consecutive conveyor means are provided for transferring the crops from the pickup to a supply aperture and for charging the crops into a compaction channel. A continuously operating rotary conveyor follows the pickup and delivers the crops into a collection space. A pivotable packer with fixed V-shaped charging elements is provided in the collection space, and is intended to charge the crops into the compaction channel after each return stroke of the compressing piston. The arrangement of this packer is unsuitable for the reliable filling of the compaction channel. During the charging step, the crops jam between the V-shaped charging element and can be returned along with the packer during its return travel. Further, the rotary conveyor pushes the crops to the rear side of the packer when the stuffing elements enter into the compaction channel with the crops being pushed into the upper corner of the collection chamber during the return travel of the packer and remaining there.

SUMMARY OF THE INVENTION

Therefore, the primary object of the present invention is to eliminate the disadvantages described above and to provide a reciprocating piston press for handling different materials and especially cardboard waste material for assuring a good filling or charging efficiency.

In accordance with the present invention, material is supplied to a compaction chamber by controlled conveyor prongs moving at a variable speed along an approximately kidney-shaped orbit, so that the travel velocity of the conveyor prongs is considerably higher in the half of the orbit directed toward a fill opening into the compaction chamber than in the other half of the orbit. Because of the kidney-shaped orbit of the conveyor prongs, they are in engagement with the material being conveyed only along a conveyor section. During the return travel of the prongs, they are pulled out of the material thus affording space for the following material moving toward the compaction channel. The higher velocity of the conveyor prongs, while conveying the material, assures a positive separation between the material being charged and the following quantity of material. Further, the travel of the prongs assures an optimum filling or charging of the compaction channel during a relatively short period while there is a complete exposure of the fill opening by the compressing piston. Since the conveyor prongs remain relatively distant from the fill opening during the return stroke of the piston, while the opening is closed, there is not any appreciable degree of precompaction which, in the instance of cardboard, would complicate charging the material into the compaction channel. Jamming of the material between the compressing piston and the fill opening is avoided. Because of the velocity of the conveyor prongs, while they are removed from the material, such movement occurs very rapidly from the path of the approaching compressing piston as well as from the charged material, whereby conveying material out of the compression channel is avoided positively. Even cardboard waste, such as paper, cardboard and the like, are reliably supplied into the compaction channel In a preferred arrangement of the invention, the conveyor prongs are controlled by a crank and rocker linkage mechanism with a non-uniformly rotating crank, and the crank is driven by a rolling gear train formed of elliptical or eccentric gear wheels. Such an arrangement is simple and free of any interruption and the drive can be effected with uniform rotation so that it is capable of being mechanical coupled with other uniformly rotating elements.

In a preferred embodiment of the invention, the compressing piston moves at a higher rate of speed during the return stroke than during the compressing stroke. As a result, the compressing piston has a shorter time period for its return travel and a longer period while the fill opening is open. This feature is particularly advantageous in connection with the relatively rapidly moving conveyor prongs. On the other hand, the compressing piston travels at a slower rate of speed during the compressing stroke and enables, in combination with the conveyor prongs moving rapidly, the path of the conveyor prongs to extend into the travel path of the piston.

A space-saving embodiment of the reciprocating piston press is achieved if the arrangement of the crank and rocker linkage mechanism is selected so that the coupling rod is under tension during the working stroke of the compressing piston.

For compressing cardboard waste, such as cardboard, paper or the like, the reciprocating piston press includes a stationary housing forming a compaction space, with a feeder space located upstream of the fill opening with such space having the supply arrangement in its upper region, while its lower region contains an approximately horizontal conveyor table for charging material through the fill opening into the compaction channel. The introduction of material into the feeder space can be effected manually or by any other independent means.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there is illustrated and described a preferred embodiment of the invention.

BRIEF DESCRIPTION OF THE DRAWING

The drawing is a schematic side view of a reciprocating piston press embodying the present invention.

DETAILED DESCRIPTION OF THE INVENTION

In the drawing, a housing 1 forms a compaction space and is supported on pedestals 2. Within the housing, there is a compaction channel formed by a rectilinear channel section 3 and an arc-shaped channel section 4. A compressing piston 6 is reciprocatably supported in the arc-shaped compaction channel section 4 and the piston pivots about a shaft 5 so that it moves back and forth between a lower position 7 shown in solid lines and an upper position 8 shown in dotted lines.

As viewed in the drawing, the compaction channel section 4, has an upper wall 9 with a fill opening 10 into the channel section and a material receiving or storage space 11 located upstream from the fill opening. In its lower position 7, the compressing piston 6 is spaced downwardly from the fill opening 10 so that material can be charged into the arc-shaped channel section 4 in the path of the piston. The material storage space 11 includes a material transfer table 12 extending between two side walls 13 and located above the lower position 7 of the compressing piston 6 for directing material toward the fill opening 10 for introduction into the compaction channel section 4. The table 12 includes a conveyor belt 15 moving at a uniform speed in the direction of the arrow 14. The transition from the conveyor belt 15 to the fill opening 10 is formed by a stationary platform 16 extending between the outlet end of the conveyor belt and the fill opening 10. The end of the platform 16, adjacent the compaction channel section 4, is located spaced closely outside of the fill opening 10 and this end of the platform is formed by a double angle bend 17 forming the lower edge of the fill opening 10. The upper side of the fill opening 10 is formed by a stationary drum-shaped surface 19 curving upwardly and outwardly from the upper wall 9 of the compaction channel section 4. The surface 19 extends first horizontally from the upper edge of the fill opening 10, and then curves upwardly above the opening. Surface 19 has slots therein extending in the circumferential direction and spaced from one another permitting conveyor prongs 20 to extend through the slots into the space 11. Conveyor prongs 20 are connected to one end of a crank 22 by means of a lug 21 and, in addition, the prongs are also connected to a coupling bar 23 of a first crank and rocker linkage mechanism. As a result, conveyor prongs 20 move through the storage space 11 when the crank 22 is rotated about a stationary pivot point 25 so that the prongs move along an approximately kidney-shaped orbit 26, located for the most part within the space 11. The orbit 26 has a conveyor section 27 so that as the conveyor prongs 20 move along in this section, they contact the material within space 11 and move it over the platform 16 and into the compaction channel section 4, passing through the fill opening 10. The orbit 26 also has a return section 28, where the conveyor prongs 20 are disengaged from the material and move along the orbit until they again engage the material along the conveyor section 27.

An elliptically-shaped gear wheel 30 is fastened on a crank shaft 29 eccentrically with respect to the pivot point 25 and this gear wheel cooperates with another gear wheel 31, also elliptically-shaped. Gear wheel 31 is connected via a shaft 32 with a gear wheel 33 co-axial with shaft 32 so that both gear wheels 31, 33 rotate as a unit. Gear wheel 33 is driven by a chain drive 34 from a drive motor 35. The gear ratio of the elliptically-shaped gear wheels 30, 31 is variable between 1:0.5 to 1:2 as maximum values. The arrangement is selected so that the largest radius of the driving gear wheel 31 is located opposite the smallest radius of the driven gear wheel 30, when the conveyor prongs 20 are located a short distance upstream from the fill opening 10 (position 180°), or the compressing piston 6 is in its lower position 7. Accordingly, the conveyor prongs 20 enter and leave the charging region at their maximum or nearly maximum velocity The drive of the compressing piston 6 is effected through a second crank and rocker linkage mechanism with the center of rotation 36 offset with respect to the pivot point 5 of the rocker 37 by an eccentric distance e, so that the crank angle designated by numeral 38 is greater than 180° during the compressing stroke. A coupling bar 39 connected at one end to the rocker 37 and at the other end to a crank 40 is stressed in tension during the movement of the compressing piston 6 upwardly from its lower position 7. Crank 40 is driven via a chain drive 41 by the drive motor 35 at a transmission ratio of 1:1 with respect to the shaft 32. The relationship between the movement of the conveyor prongs 20 and the compressing piston 6 can be appreciated by the markings and degree values shown on the orbit 26 of the conveyor prongs 20. Proceeding from the 0° position of the crank 40 in the lower position 7 of the compressing piston 6, the markings on the orbit 26 designate the position of the prongs for each 30° of crank rotation in the rotational direction displayed by the arrow 42. Between positions 150° and 240°, the conveyor prongs 20 move most rapidly as compared to the upstream positions where they move more slowly such as at the 30° position.

The reciprocating piston press operates in the following manner:

Waste cardboard to be compacted is directed into the space 11 while the machine rotates in the direction of the arrow 42. Conveyor belt 15 is driven in the direction of the arrow 14 and conveys the material onto the platform 16. At the same time, conveyor prongs 20, driven in the direction of the arrow 44, move downwardly through the orbit 26 causing the material to bend and buckle and move toward the fill opening 10. In the range between the 150° position and the 210° position, as the prongs move rapidly above the platform 16, the material is forced through the fill opening 10 into the arc-shaped compaction channel section 4, with the compressing piston 6 arriving at its lower position 7 in the 180° position of the conveyor prongs 20. After charging the material into the compaction channel section 4, the conveyor prongs 20 move back out of the channel section 4 out of contact with the material initially moving rapidly along the return section 28 of the orbit 26. Any material which may still adhere to the conveyor prongs 20 is wiped off, at the latest, when the conveyor prongs enter into the space defined by the surface 19 with the material falling under the influence of gravity into the compaction channel section 4. With the material directed into the compaction channel section 4, the compressing piston 6 is driven in the direction of the arrow 43 and pushes against and compacts the material from the section 4 into the section 3 of the compaction channel. In the upper position 8 of the compressing piston 6, a trailing piston plate 45 closes the fill opening 10 and the conveyor prongs located between the 0° up to 60° positions afford a maximum opening of the space 11. At this point, a new cycle of the press commences. When a predetermined length of a bale of the material is reached, the bale is tied in the compaction channel section 4 by a known tie-up device, not illustrated, and then is ejected.

While specific embodiments of the invention have been shown and described in detail to illustrate the application of the inventive principles, it will be understood that the invention may be embodied otherwise without departing from such principles.

I claim:

1. Reciprocating piston press comprising an elongated compaction channel having a first end and a second end, said compaction channel having an arc-shaped section extending in the elongated direction from adjacent the first end toward the second end, a compressing piston located within said arcuate section, means connected to said piston for reciprocating said piston therein along a path moving toward and away from the second end of said compaction channel, said arcuate section has a fill opening for receiving material therein in the path of said reciprocating piston, means for conveying the material through said fill opening into said arcuate section into the path of said reciprocating piston in a timed relationship with the reciprocation of said piston, wherein the improvement comprises that said means for conveying the material includes conveyor prongs and means for moving said prongs toward and away from said fill opening at varying velocities and moving said prongs along an approximately kidney-shaped orbit, said orbit has a rounded first end located in the fill openings and a rounded second end spaced outwardly from the fill opening, said orbit having a first section extending from the second end to the first end where said prongs move toward said fill opening and a second section extending from the first end to the second end where said prongs move away from said fill opening and the velocity of said prongs is considerably higher in said first section as said prongs approach said fill opening, said means for moving said prongs comprises a first crank and rocker linkage mechanism comprising a non-uniformly rotating crank connected to a first end of said prongs and a coupling bar connected to the first end of said prongs and extending therefrom at an angle to said crank, a crank drive connected to said crank at a distance spaced from the first end of said prongs and comprising a rolling gear train, said rolling gear train comprising one of elliptical and eccentric gear wheels in meshed engagement.

2. Reciprocating piston press, as set forth in claim 1, wherein said reciprocating path of movement of said compressing piston comprises a compressing stroke and a return stroke, and said means for reciprocating said piston arranged to drive said piston so that the return stroke thereof has a higher velocity than the compressing stroke.

3. Reciprocating piston press, as set forth in claim 2, wherein said means for reciprocating said piston comprises a second crank and rocker linkage mechanism where the crank angle is greater than 180° during the compressing stroke.

4. Reciprocating piston press, as set forth in claim 3, wherein said second crank and rocker linkage mechanism comprises a rocker secured to said compressing piston, a coupling bar connected at one end to said rocker and at the other end to a crank driven by a chain drive, and said coupling bar being subjected to tension during the compressing stroke of said compressing piston.

5. Reciprocating piston press, as set forth in claim 3, wherein a drive motor provides the motive force for said first and second crank and rocker linkage mechanisms.

6. Reciprocating piston press, as set forth in claim 2, including means forming a space for receiving material to be charged into said compaction channel, said space being open to said fill opening, said space having an upper region and a lower region with said conveyor prongs moving through said upper region, said lower region comprises an approximately horizontal feed table over which the material moves toward the fill opening.

7. Reciprocating piston press, as set forth in claim 6, wherein said feed table comprises a uniformly moving conveyor belt spaced from said fill opening and a stationary platform extending from said conveyor belt to said fill opening.

8. Reciprocating piston press, as set forth in claim 7, wherein a drum-shaped surface is located in said space above said fill opening, said surface having slots therethrough, said conveyor prongs extending through said slots in said surface and being displaceable through said slots at varying distances into said space.

9. Reciprocating piston press, as set forth in claim 1, wherein said compaction channel comprises a rectilinear section extending from said arcuate section to the second end thereof.

* * * * *